US006699100B1

(12) United States Patent
Burns

(10) Patent No.: US 6,699,100 B1
(45) Date of Patent: Mar. 2, 2004

(54) STUFFED TOY FOR HOLDING GREETING CARD OR GIFT ITEMS

(76) Inventor: Judy K. Burns, 948 Masonridge Rd., St. Louis, MO (US) 63141

( * ) Notice: Subject to any disclaimer, the term of this patent is extended or adjusted under 35 U.S.C. 154(b) by 0 days.

(21) Appl. No.: 10/350,406

(22) Filed: Jan. 24, 2003

(51) Int. Cl.[7] ..... A63H 3/02
(52) U.S. Cl. ..... 446/369; 446/370
(58) Field of Search ..... 446/369, 371, 446/376, 379, 382, 390

(56) References Cited

U.S. PATENT DOCUMENTS

| | | | | | |
|---|---|---|---|---|---|
| 440,986 | A | | 11/1890 | Alderson | 446/359 |
| 2,733,545 | A | * | 2/1956 | Guadagna | 446/330 |
| 3,071,893 | A | | 1/1963 | Schwartz | 446/390 |
| 3,693,288 | A | | 9/1972 | Lewis et al. | 446/330 |
| 3,696,553 | A | | 10/1972 | Lewis et al. | 446/330 |
| 3,731,427 | A | * | 5/1973 | Lewis et al. | 446/134 |
| 3,928,933 | A | | 12/1975 | Iwamoto | 446/330 |
| 4,057,612 | A | | 11/1977 | Clark et al. | 264/275 |
| 4,095,367 | A | | 6/1978 | Ogawa | 46/105 |
| 4,152,865 | A | | 5/1979 | Ikeda | 46/116 |
| 4,186,517 | A | * | 2/1980 | Kuhn et al. | 446/330 |
| 4,407,090 | A | | 10/1983 | Pyo et al. | 46/118 |
| 4,725,257 | A | | 2/1988 | Barishman et al. | 446/370 |
| 4,729,751 | A | | 3/1988 | Schiavo et al. | 446/268 |
| 4,950,196 | A | | 8/1990 | Fortune et al. | 446/73 |
| 5,762,569 | A | | 6/1998 | Hale | 473/480 |

* cited by examiner

*Primary Examiner*—Kien T. Nguyen
(74) *Attorney, Agent, or Firm*—Grace J. Fishel

(57) ABSTRACT

A stuffed toy, such as an animal or doll, incorporates a display mechanism. The display mechanism permits the stuffed toy to hold opposing edges of an object, for example, a card, and to hold the object securely. The display mechanism permits the stuffed toy to hold the object transversely across the body of the toy so that the front and back of the card are visible to a viewer. The display mechanism also permits the toy to hold a plurality of objects for display. The display mechanism may simulate the action of gripping hands, for example, by including clamping jaws placed in the arms or hands of the toy.

8 Claims, 5 Drawing Sheets

STUFFED TOY FOR HOLDING GREETING CARD OR GIFT ITEMS

BACKGROUND OF THE INVENTION

1. Field of the Invention

The present invention relates to a stuffed toy incorporating a display mechanism for holding a greeting card or gift items.

2. Brief Description of the Prior Art

Greeting cards are commonly given on special occasions such as birthdays, graduation and so forth, frequently accompanied by a small gift. Cards are not inexpensive and it is difficult to find a small gift that is not likely to be immediately discarded or regifted.

Stuffed toys, more particularly stuffed bears, have enjoyed a tremendous popularity and are frequently combined by florists and retailers of novelties with flowers, balloons, cups of candy or the like to form a gift. A stuffed bear, not being too feminine, is an acceptable gift for most men as well as women.

Greeting cards are typically selected because they are beautiful or because they have a clever message which is targeted at the recipient. Rather than discarding the greeting card, it would be desirable to have a way for the recipient to display the card such that both the inside of the card with the giver's name and the outside are visible in connection with the gift.

The present invention provides a stuffed toy incorporating a display mechanism for holding a greeting card. The stuffed toy with card may be given alone as an attractive, relatively inexpensive small gift or combined with flowers, etc. to make a more elaborate display.

The following U.S. Patents are incorporated by reference herein: U.S. Pat. Nos. 440,986, 3,071,893, 3,693,288, 3,696,553, 3,928,933, 4,057,612, 4,095,367, 4,152,865, 4,407,090, 4,590,196, 4,725,257, 4,729,751 and 5,762,569.

BRIEF SUMMARY OF THE INVENTION

In view of the above, it is an object of the present invention to provide a stuffed toy that is capable of holding and displaying a card such as a greeting card. It is another object to provide a stuffed toy for holding a card in a manner such that the inside of the card with the giver's name and the outside of the card are visible in connection with the gift. Other objects and features of the invention will be in part apparent and in part pointed out hereinafter.

The device of the invention is a stuffed toy in the form of an animal such as a bear, rabbit, chick, seal or the like with movable upper limbs in which are incorporated a display mechanism for gripping a card such as a greeting card by opposite side edges or for holding other gift items. The device of the invention permits the displayed material to be readily visible to anyone viewing the toy. In particular, the device of the invention permits opposite side edges of a card to be gripped by the animal's paws and displayed frontally transverse the animal's midsagittal plane such that the front and back of the card can be read. The device of the invention may also be used to grip other gift items such as a balloon on a stick, lollypop, etc., along with or in place of a card.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
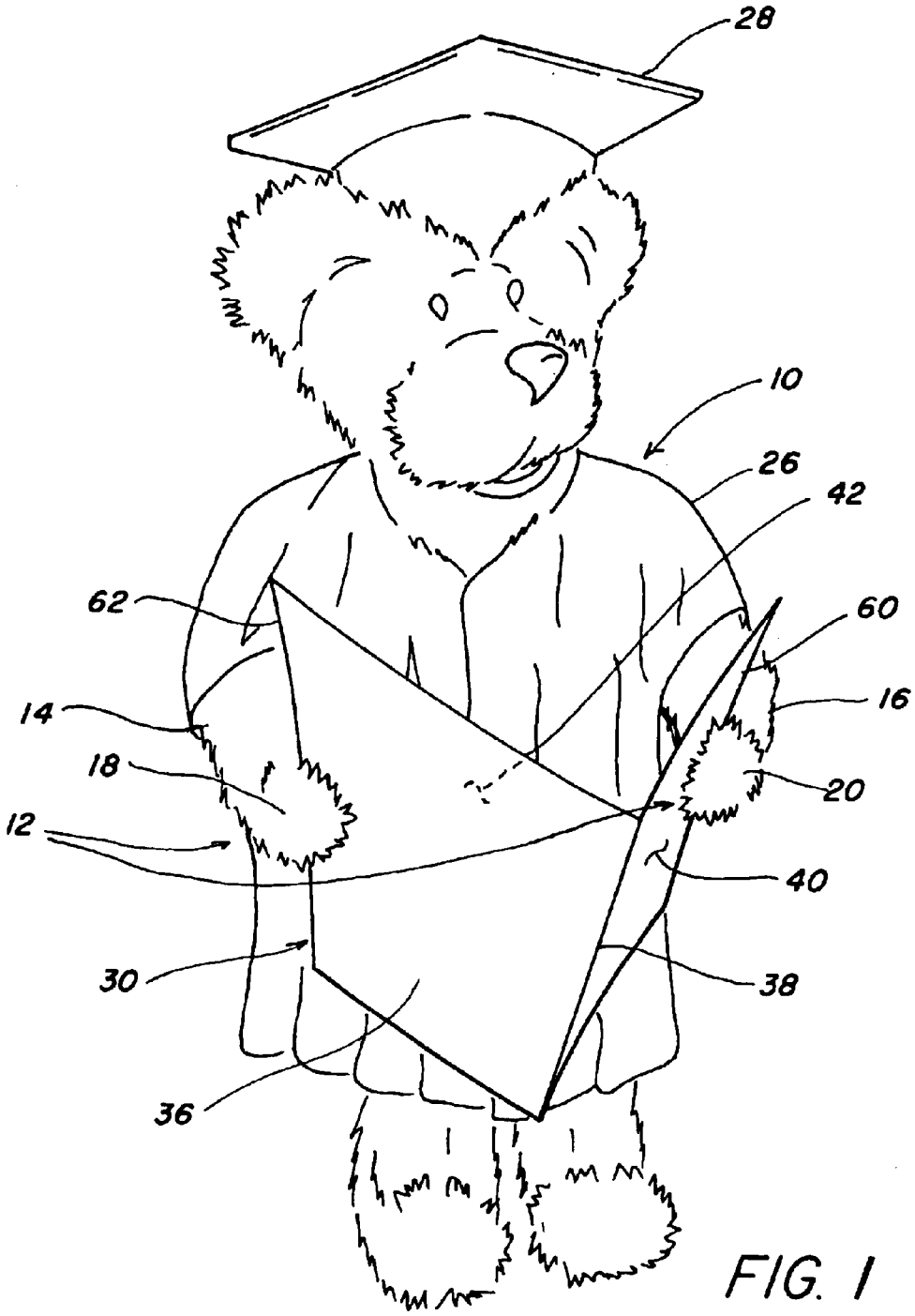
FIG. 1 is a front view of a stuffed toy shown displaying a card such that the front and back are visible to a viewer in accordance with the present invention.
Figure 6:
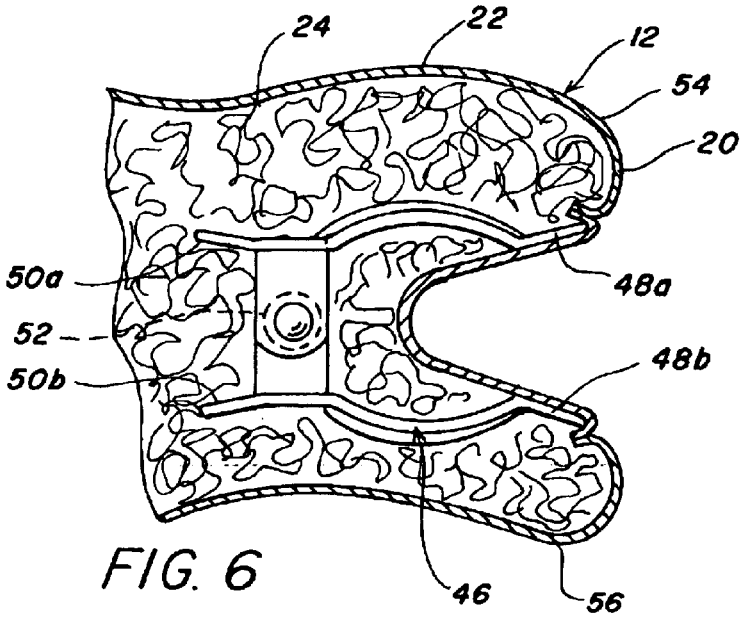
FIG. 6 is a partial cross-sectional view of the display mechanism of FIG. 5, and is taken along the plane VI—VI in FIG. 5.
Figure 8:
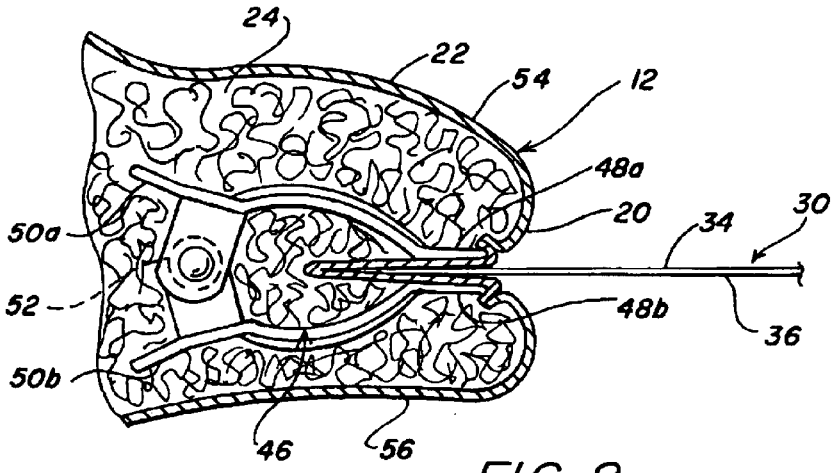

Referring to FIG. 1, a stuffed toy 10 incorporating a display mechanism 12 in accordance with the present invention is shown as a stuffed animal, i.e., a toy bear 10 with movable upper right and left limbs 14, 16, respectively. When stuffed toy is in the form of a bear, rabbit, dog, deer or the like, upper limbs are legs and terminate at 18, 20 in paws or hooves. With other animals, e.g., chicks, ducks, seals, etc., upper limbs 14, 16 are wings or flippers, while the upper limbs of human-like dolls or monkeys are arms terminating in hands 18, 20. As shown in FIGS. 6 and 8 a pliable covering 22 on stuffed toy 10 is made of plush, fabric, plastic cloth or the like, as appropriate to the animal, and the toy is stuffed 24 with a fiber or sponge filling.

Figure 4:
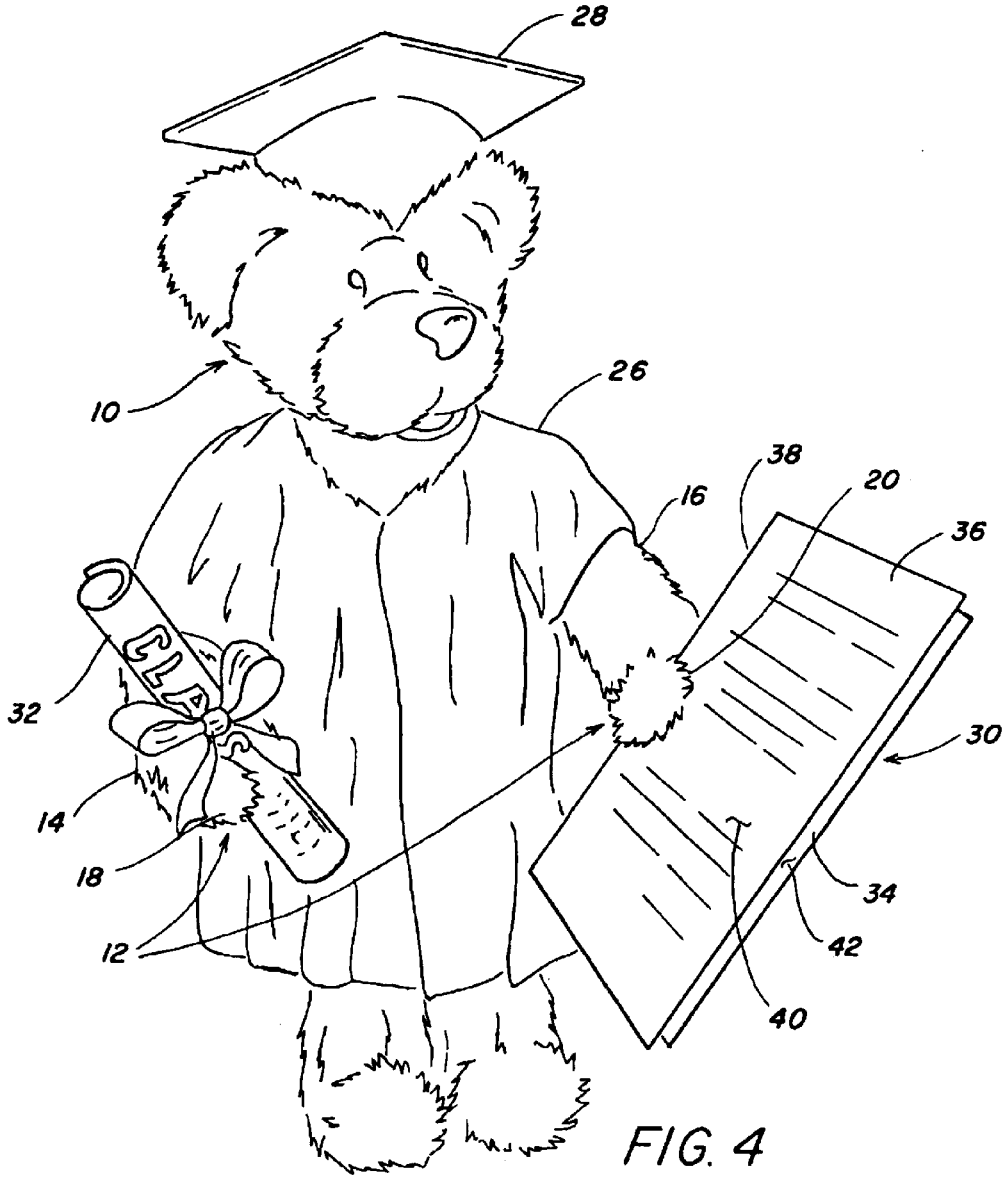
FIG. 4 is a front view of a stuffed toy shown displaying a roll of paper simulating a diploma in one hand and a folded greeting card in the other hand.

With continuing reference to FIG. 1, toy bear 10 is dressed as it might be for a graduation gift with an academic gown 26 and a mortar board 28. Toy bear 10 is shown holding a card 30 which may be a greeting card containing a message of congratulations. Alternatively, as shown in FIG. 4, toy bear 10 may hold a rolled paper 32 simulating a diploma in its right hand 18 and card 30 in its left hand 20.

Figure 2:
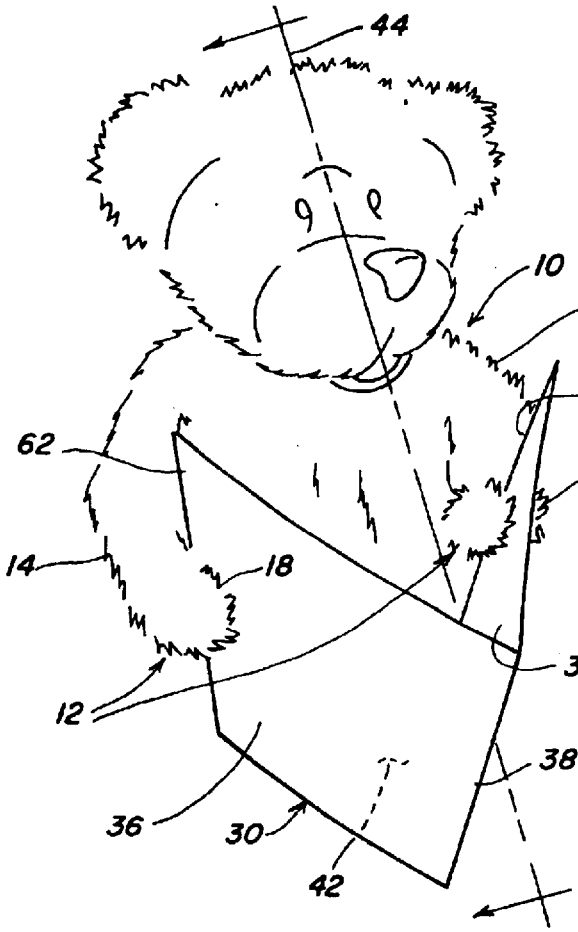
FIG. 2 is a partial front view of a stuffed toy showing the toy holding a greeting card.
Figure 3:
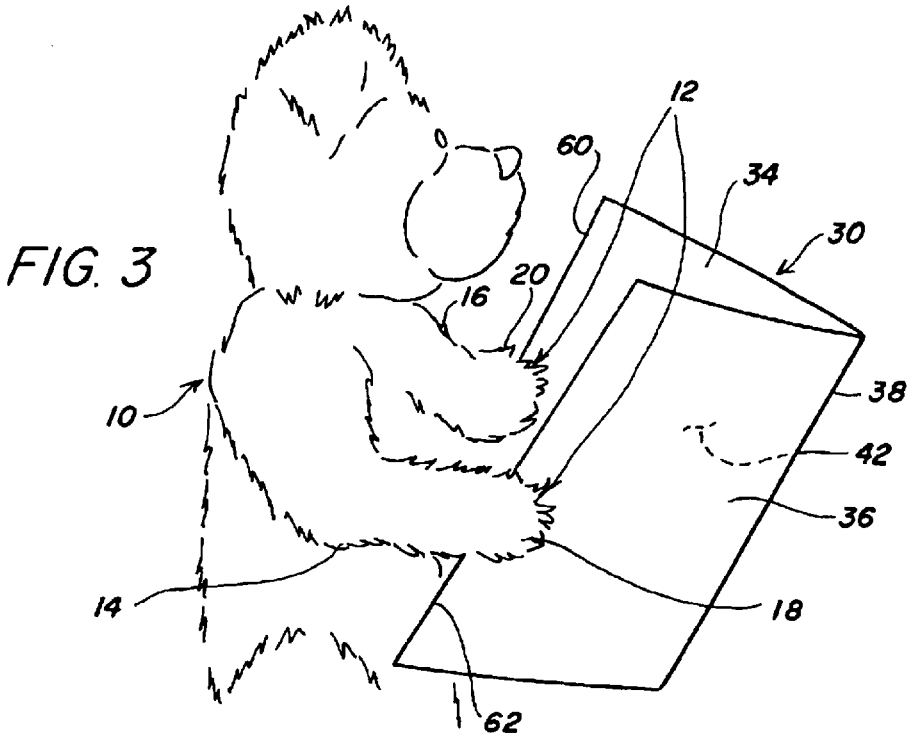
FIG. 3 is a right side view of the stuffed toy of FIGS. 1 and 2.

As shown in FIGS. 1–3, card 30 has an inside 34 and an outside 36 and is folded at 38 to form an outside front panel 40 and an inside rear panel 42. Usually a salutation appropriate to the occasion is printed on front panel 40 and rear panel 42 is signed by the giver. As shown, toy bear 10 holds a card 30 along opposite side edges with the card gripped between right and left hands 18, 20. In this position, card is displayed frontally transverse the animal's midsagittal plane (see phantom line 44 in FIG. 2) with front and rear panels 40, 42 visible to a person examining the gift.

Figure 5:
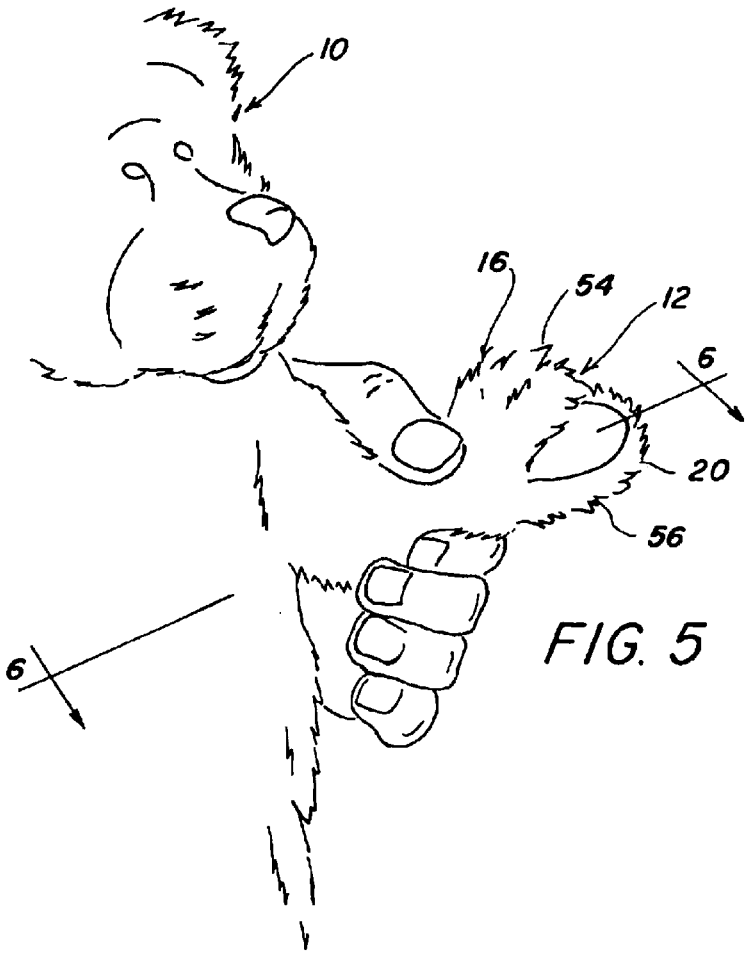
FIG. 5 is a partial front view of the stuffed toy of the invention detailing a display mechanism in combination with FIG. 6.

Display mechanism 12 is best understood with reference to FIGS. 5–8. A spring biased means 46 for gripping and holding is incorporated into right and left hands 18, 20 of toy bear 10. As illustrated, spring biased means 46 includes two clamping jaws 48*a*, 48*b*, two lever arms 50*a*, 50*b* and a spiral spring 52. Clamping jaws 48*a*, 48*b* are biased to the holding position shown in FIGS. 7 and 8 by spiral spring 52 and spread into receiving position as shown in FIGS. 5 and 6 when lever arms 50*a*, 50*b* are pinched together. Spring biased means 46 may be asymmetrically embedded in right and left hands 18, 20 with stuffing 24 molded around clamping jaws 48*a*, 48*b* such that the hand is bifurcated with a grouping of fingers 54 and an opposable thumb 56.

The operation of the device of the invention may be further understood by referring to FIGS. 5 through 8. As shown, toy bear 10 has arms 14, 16 which are flexible. As shown for left arm 16, the arms terminate in hands 18, 20 which incorporate a display mechanism 12, as described above. As shown in FIGS. 5 and 6, the display mechanism may be operated by a user 58 manually compressing the lever arms 50*a*, 50*b* of spring biased means 46. Clamping jaws 48*a*, 48*b* are opened to the receiving position shown in FIG. 6 with thumb 56 separated from fingers 54.

Figure 7:
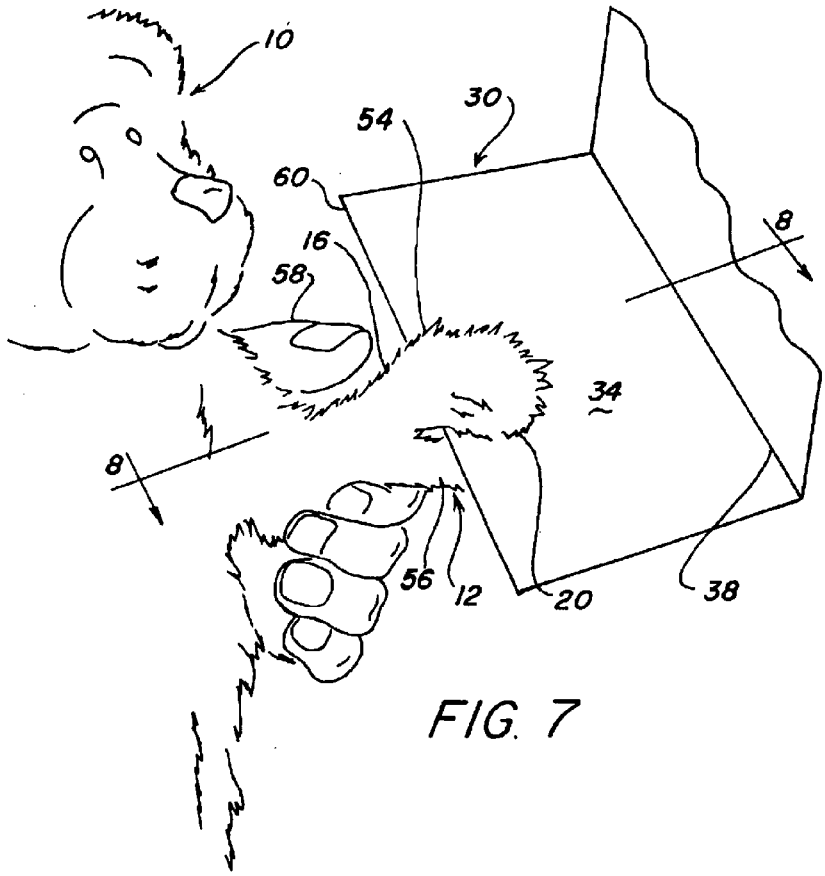
FIG. 7 is a partial front view of a stuffed toy of the invention detailing the display mechanism in combination with FIG. 8 with a card held in the display mechanism; and, FIG. 8 is a partial cross-sectional view of the display mechanism and card of FIG. 7, taken along the plane VIII—VIII, and is similar to the view of FIG. 6.

As shown in FIG. 7, a side edge 60 of card 30 may be inserted between thumb 56 and fingers 54 of display mechanism 12. The manual pressure on lever arms 50*a*, 50*b* of spring biased means 46 of display mechanism 12 is released, allowing clamping jaws 48*a*, 48*b* to close. Closed clamping jaws 48*a*, 48*b* close the bifurcated fingers 54 and opposable thumb 56 of the display mechanism 12 onto a side edge of card 30 and hold the card, as shown in FIG. 8. It will be appreciated that a similar operation allows right hand 18 of toy bear 10 to grip and hold an opposite side edge 62 of card 30, as shown in FIGS. 1—3. The grip of the spring biased means 46 is sufficiently secure that card 30 does not slip from bifurcated gripping fingers 54 and opposable thumb 56. Flexible arms 14, 16 of toy bear 10 permit hands 18, 20 to hold card 30 transversely across the body of toy bear 10, for example as shown in FIGS. 1—3, and allow any information on card 30 to be readily seen.

It will be appreciated that the device of the invention also permits a plurality of objects to be held, as shown in FIG. 4. As shown, diploma 32 is held in right hand 18 of toy bear 10 and folded card 30 is held in left hand 20 of toy bear 10. Many other objects, and combinations of objects such as a balloon on a stick, lollypop, etc., may be held and displayed by the device of the invention, as will be appreciated by those skilled in the art.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A stuffed toy incorporating a display mechanism, the toy having a pliable outer covering and a flexible, shape producing internal body, said toy filled with a fiber or sponge filling, the toy has a plurality of appendages including first and second flexible limbs extending from the toy, the display mechanism having a first spring biased means with a pair of jaws and lever arms for gripping and holding an object to be displayed incorporated in a free end of the first limb, the display mechanism having a second spring biased means with a pair of clamping jaws and lever arms for gripping and holding an object to be displayed incorporated in a free end of the second limb, the stuffed toy including means for cooperation between the first and second spring biased means for positioning the first and second spring biased means generally in opposition to hold an object to be displayed in a position extending transversely across the body of the toy.

2. The toy of claim 1 wherein the two clamping jaws and two lever arms are connected by a spiral spring.

3. The toy of claim 2 wherein the first and second limbs are bifurcated at the distal portion of each limb.

4. The toy of claim 3 wherein the bifurcated portions of the limbs include the clamping jaws of the spring biased means.

5. The toy of claim 4 wherein the bifurcated portions of the limbs are asymmetric to form a group of fingers and an opposing thumb.

6. A stuffed toy incorporating a display mechanism, said toy filled with a fiber or sponge filling, the toy having a body and first and second flexible arms extending outwardly from the body, each arm terminating in a hand portion at a distal end of the arm, the hand portion being bifurcated and having gripping fingers and an opposable thumb, each hand portion having an interior, the display mechanism having a spring biased gripping device incorporated in the interior of each hand portion, the spring biased gripping device having a pair of clamping jaws and lever arms, said clamping jaws extending into the interior portions of the gripping fingers and opposable thumb of the hand portion and the lever arms being in the hand portion, the spring biased gripping device biasing the gripping jaws into a closed, gripping position and biasing the bifurcated gripping fingers and opposable thumb into a closed gripping position, the stuffed toy including means for cooperation between the gripping device in each hand for positioning them generally in opposition to hold an object to be displayed in a position extending transversely across the body of the toy.

7. The toy of claim 6 wherein the lever arms may be used to release the spring biased gripping device from a closed gripping position to an open releasing position in response to manual pressure.

8. A stuffed toy incorporating a display mechanism, said toy filled with a fiber or sponge filling, the toy having a body and a pair of flexible arms extending outwardly from the body, the arms terminating in distal portions, the distal portions of the arms having hand elements in a free end thereof, the hand elements having bifurcated portions forming gripping fingers and an opposable thumb, the gripping fingers and opposable thumb accepting an object to be displayed and releasably holding the object, the hand elements having interior portions, the interior portions of each hand element having a spring biased gripping device in a free end thereof, each spring biased gripping device having clamping jaws extending into the interior portions of gripping fingers and opposable thumb of each hand element, the spring biased gripping devices biasing the clamping jaws of the spring biased gripping devices into a closed gripping position and biasing the gripping fingers and opposable thumb of each hand element into a closed gripping position, the spring biased gripping devices having lever arms thereon cooperating to release the closed gripping position of the clamping jaws in response to manual pressure, the stuffed toy including means for cooperation between the spring biased gripping devices for positioning them generally in opposition to hold an object to be displayed in a position extending transversely across the body of the toy.

* * * * *